US006966547B2

(12) United States Patent
Colliander

(10) Patent No.: US 6,966,547 B2
(45) Date of Patent: Nov. 22, 2005

(54) FENCE SLAT SYSTEM

(75) Inventor: Alan C. Colliander, Hastings, MN (US)

(73) Assignee: The Loxcreen Company, Inc., West Columbia, SC (US)

( * ) Notice: Subject to any disclaimer, the term of this patent is extended or adjusted under 35 U.S.C. 154(b) by 0 days.

(21) Appl. No.: 10/707,247

(22) Filed: Dec. 1, 2003

(65) Prior Publication Data

US 2005/0116211 A1 Jun. 2, 2005

(51) Int. Cl.[7] ..... E04H 17/02

(52) U.S. Cl. ..... 256/32; 256/1; 256/19; 256/24; 256/34

(58) Field of Search ..... 256/1, 19, 24, 256/32, 34

(56) References Cited

U.S. PATENT DOCUMENTS

| | | | | |
|---|---|---|---|---|
| 4,085,954 A | | 4/1978 | Thompson | 256/34 |
| 4,512,556 A | | 4/1985 | Meglino | 256/34 |
| 4,570,906 A | | 2/1986 | Walden | 256/34 |
| 4,723,761 A | | 2/1988 | Cluff | 256/34 |
| 4,725,044 A | | 2/1988 | Cluff | 256/34 |
| 4,836,505 A | | 6/1989 | Meglino | 256/34 |
| 4,860,997 A | | 8/1989 | Schoenheit et al. | 256/34 |
| 4,860,998 A | | 8/1989 | Snyder | 256/34 |
| 4,950,098 A | | 8/1990 | Abbott et al. | 403/34 |
| 4,995,591 A | | 2/1991 | Humphrey et al. | 256/34 |
| 5,007,619 A | | 4/1991 | Sibeni | 256/34 |
| 5,056,761 A | | 10/1991 | Meglino et al. | 256/34 |
| 5,106,058 A | | 4/1992 | Finkelstein | 256/34 |
| 5,165,664 A | | 11/1992 | Cluff | 256/34 |
| 5,184,801 A | | 2/1993 | Finkelstein | 256/34 |
| 5,234,199 A | | 8/1993 | Cluff | 256/34 |
| 5,275,380 A | | 1/1994 | Barsby | 256/34 |
| 5,275,381 A | | 1/1994 | Cluff et al. | 256/35 |
| 5,395,092 A | | 3/1995 | McLaughlan et al. | 256/34 |
| 5,458,319 A | | 10/1995 | Mackay | 256/34 |
| 5,465,941 A | | 11/1995 | Abbott | 256/34 |
| 5,482,256 A | | 1/1996 | Caron | 256/34 |
| RE35,208 E | | 4/1996 | Finkelstein | 256/34 |
| 5,584,468 A | | 12/1996 | Meglino et al. | 256/34 |
| 5,651,533 A | | 7/1997 | Ling | 256/34 |
| 5,687,957 A | | 11/1997 | Finkelstein | 256/34 |
| 5,775,676 A | | 7/1998 | Hoggan | 256/34 |
| 5,794,922 A | | 8/1998 | Meglino et al. | 256/34 |
| 5,799,929 A | | 9/1998 | Meglino et al. | 256/34 |
| 5,806,839 A | | 9/1998 | Meglino | 256/34 |
| RE36,085 E | | 2/1999 | McLaughlan et al. | 256/34 |
| 5,899,442 A | | 5/1999 | Meglino et al. | 256/32 |
| 5,988,599 A | * | 11/1999 | Forbis | 256/24 |
| 6,068,243 A | | 5/2000 | Hoggan | 256/34 |
| 6,164,628 A | | 12/2000 | Hoggan | 256/34 |
| 6,182,947 B1 | | 2/2001 | Meglino | 256/34 |
| 6,402,127 B1 | | 6/2002 | Meglino et al. | 265/65 |

* cited by examiner

*Primary Examiner*—Daniel P. Stodola
*Assistant Examiner*—Michael P. Ferguson
(74) *Attorney, Agent, or Firm*—Sutherland Asbill & Brennan LLP

(57) ABSTRACT

A fence slat. The fence slat may include a longitudinal body. The longitudinal body may include a first side with a first sidewall positioned thereon and a second side with a second sidewall positioned thereon. The sidewalls may include a locking portion positioned thereon. The sidewalls may be curved.

12 Claims, 3 Drawing Sheets

FENCE SLAT SYSTEM

BACKGROUND OF INVENTION

1. Technical Field

The present invention relates generally to slats that are inserted into a chain link fence and more particularly relates to fence slats that lock into place.

2. Background of the Invention

Chain link fences generally are inexpensive, easy to install, and easy to maintain. Chain link fences therefore have become a popular way to secure portions of land. A chain link fence, however, may not provide a great deal of privacy. Further, a chain link fence may not be considered as attractive as, for example, a wooden fence.

Plastic fence slats may be woven between the consecutive links of the chain link fence to increase privacy, improve aesthetics, and provide wind protection. The fence slats, however, may have a tendency to slip out of the links of the fence. This slippage may cause the fence slats to become misaligned and/or may reduce the overall effectiveness of the slats with respect to privacy and aesthetics.

There is a desire, therefore, for a fence slat system that quickly and easily locks the slats into place. The fence slats preferably should be easy to install and reasonable priced as compared to existing devices.

SUMMARY OF INVENTION

The present invention thus provides a fence slat. The fence slat may include a longitudinal body. The longitudinal body may include a first side with a first sidewall positioned thereon and a second side with a second sidewall positioned thereon. The sidewalls may include a locking portion positioned thereon. The sidewalls may be curved.

The longitudinal body may include a rib positioned therein. The rib also may include the locking portion. The longitudinal body may include a tube. The tube may include a substantially flat first side and a substantially flat second side. The rib may separate the substantially flat first side and the substantially flat second side. The tube may include a first end and a second end. The first end may include the locking portion. The substantially flat first side may include a terminating point adjacent to the first end.

The locking portion may include a harpoon shape, an arrow shape, or any other desired shape. The locking portion may include a cutout portion and an elevated portion. The locking portion also may include an upper cutout portion and a lower cutout portion. A second locking portion also may be used.

The curved sidewalls may have a curve towards or away from the longitudinal body. The longitudinal body may include one or more flat strips. The longitudinal body also may include a number of rail apertures therein.

A further embodiment of the fence slat may include a longitudinal body with a first wall and a second wall. A pair of sidewalls and a rib may connect the first wall and the second wall. The sidewalls and the rib may include a locking portion positioned thereon.

A further embodiment may include a fence slat system. The system may include a fence slat and a slat retainer. The fence slat may include a longitudinal body with a pair of curved sidewalls positioned thereon. The sidewalls may include a fence slat locking portion positioned thereon. The slat retainer may include a slat retainer locking portion sized to accommodate the fence slat locking portion.

The slat retainer locking portion may include an elevated portion with a cutout portion, an indented portion, or any convenient shape. The longitudinal body may include a number of rail apertures therein. A rail may be positioned in the rail apertures.

These and other features of the present invention will become apparent upon review of the following detailed description, when taken in conjunction with the drawings and appended claims.

DETAILED DESCRIPTION

Figure 1:
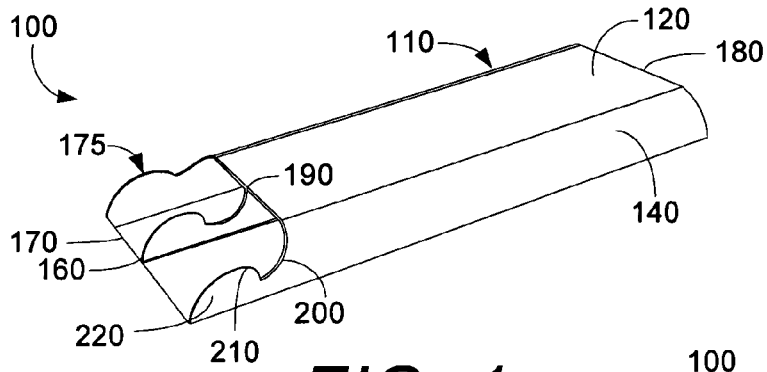
FIG. 1 is a perspective view of a fence slat of the present invention.
Figure 2:
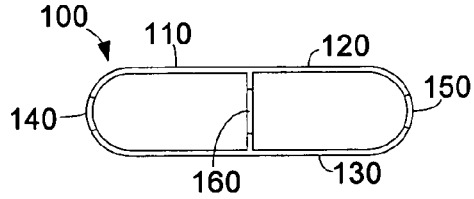
FIG. 2 is an end plan view of the fence slat of FIG. 1.

Referring now to drawings, in which like numerals represent like elements throughout several views, FIGS. 1–2 show a fence slat 100 of the present invention. As is shown, the fence slat 100 may be in the shape of a substantially flattened tube 110. The tube 110 may be substantially hollow. The tube 110 may have a substantially flat first side 120 and a substantially flat second side 130. The sides 120, 130 may be connected by a first curved sidewall 140 and a second curved sidewall 150. The sidewalls may be any desired degree of curvature. The tube 110 further may have a rib 160 connecting the first side 120 and the second side 130. The rib 160 may run the length of the tube 110 or only one or more portions thereof.

The tube 110 may have a first end 170 and a second end 180. The first side 120 of the tube 110 may terminate before reaching the first end 170. The first side 120 may terminate at about a terminating point 190. Likewise, the second side 130 also may terminate at about the same point 190. The sidewalls 140, 150 and the rib 160 may form a locking portion 175 about the first end 170. The locking portion 175 may be in a substantial "harpoon" shape below the terminating point 190. Although such a "harpoon" shape is shown, the locking portion 175 may take any desired shape.

Specifically, the sidewalls 140, 150 and the rib 160 may have a first cutout portion 200 that descends from the first side 120 through the width of the sidewalls 140, 150 and the rib 160 towards the second side 130. Although the first cutout portion 200 is shown as curved, any desired angle or shape may be used. The first cutout portion 200 may then lead to an elevated portion 210. The elevated portion 210 may rise back towards the first side 120. Although the elevated portion 210 is shown as being substantially vertical, any desired angle or shape may be used. The elevated portion 210 then may lead to a second cutout portion 220. The second cutout portion 220 again descends towards the second side 130, and more particularly, the first end 170. Although the second cutout portion 220 is shown as being curved, any desired angle or shape may be used.

The tube 110 generally may be made out of a plastic such as high density polyethylene (HDPE), polypropylene, rigid polyvinyl chloride (PVC), or similar types of materials. Any somewhat flexible material, however, may be used. As described above, the tube 110 may be any desired length. The tube 110 generally runs in length from about one (1) to about four (4) meters. The tube 110 may have a depth (i.e., the distance separated by the rib 160) of about seven (7) to about ten (10) millimeters. The tube 110 may have a width (i.e., the distance separated by the first and the second side 120, 130) of about twenty-one (21) to about thirty-three (33) millimeters. The terminating point 190 may be about eighteen (18) to about twenty-one (21) millimeters from the first end 170. The first cut out portion 200 may have a depth of about three (3) to about four (4) millimeters while the elevated portion 210 may rise about another two (2) to about three (3) millimeters. It is important to note that these dimensions are for the purposes of example only and that any desired dimensions may be used.

Although tube 110 has been described as using of the locking portion 175 on the first end 170, a similar locking portion 175 may be positioned about the second end 180 as well. Similarly, two (2) locking portions 175 also may be used about the first end 170 and the second end 180.

Figure 3:
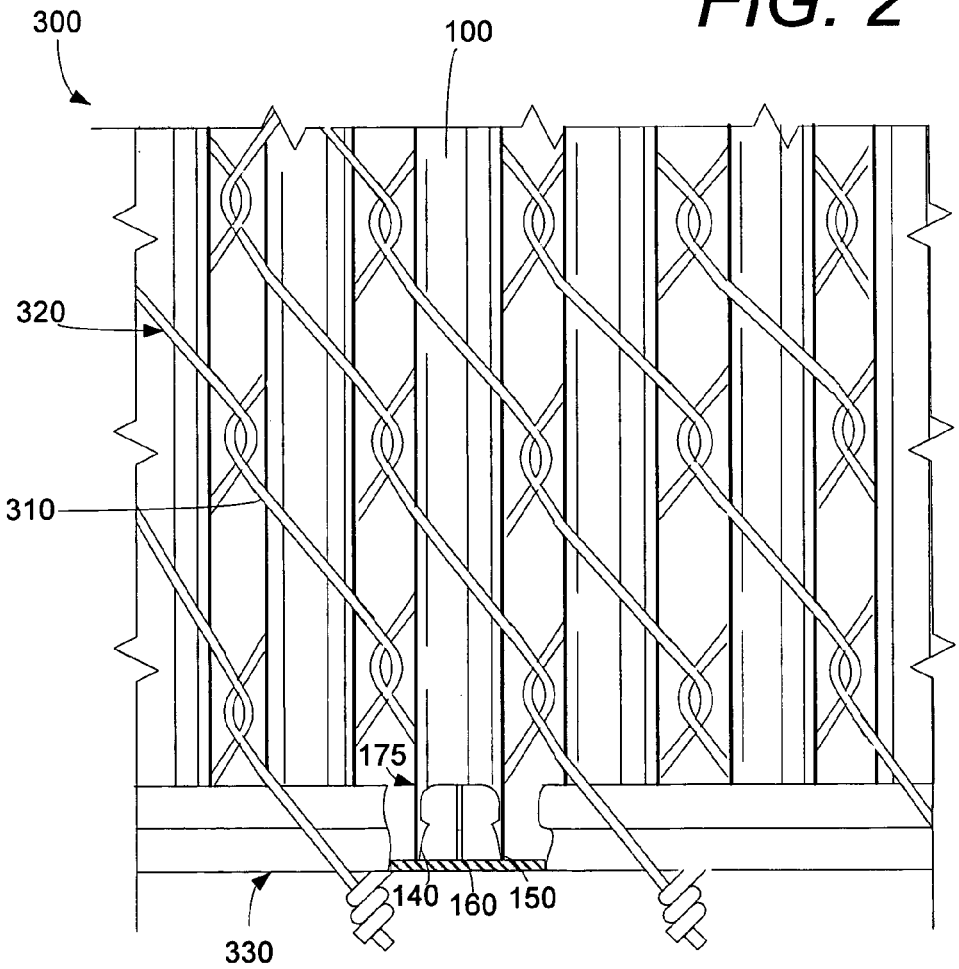
FIG. 3 is a front plan view of a fence slat system of the present invention with a number of fence slats inserted through a chain link fence and with the slat retainer partially cut away.
Figure 4:
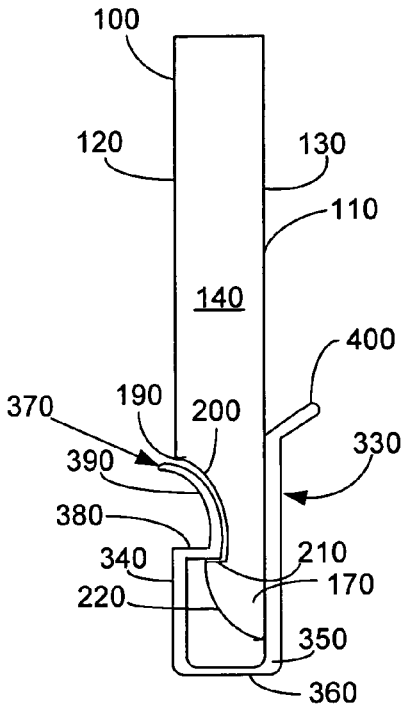
FIG. 4 is a side cross-sectional view of the fence slat and the slat retainer of FIG. 3.

FIGS. 3 and 4 show a fence slat locking system 300. The system 300 includes any number of the fence slats 100 woven between the links 310 of a conventional chain link fence 320. Each fence slat 100 may be locked into a slat retainer 330. The slat retainer 330 may be positioned along the bottom, the top, or both ends of the chain link fence 320. The slat retainer 330 may be made out of a plastic such as high density polyethylene, polypropylene, rigid polyvinyl chloride or similar types of materials. Any somewhat rigid material, however, may be used.

The slat retainer 330 may have a first side 340 and a substantially parallel second side 350. A base 360 may separate the sides 340, 350. The first side 340 and/or the second side 350 of the slat retainer 330 may have a locking portion 370 designed to mate with the locking portion 175 of the fence slat 100. Specifically, the locking portion 370 of the slat retainer 330 may have an elevated portion 380 of similar dimension and shape to that of the elevated portion 210 of the fence slat 100. If positioned on the first side 340 of the slat retainer 330, the elevated portion 380 may extend towards the second side 350. The elevated portion 380 of the slat retainer 330 may then extend into a cutout portion 390. The cutout portion 390 may be similar in dimension and shape to that of the first cutout portion 200 of the fence slat 100. If positioned on the first side 340 of the slat retainer 330, the cutout portion 390 may extend away from the second side 350. Both sides 340, 350 may end in a flared-out portion 400. Any desired shape may be used.

The slat retainer 330 may have any desired length. Likewise, any number of slat retainers 330 may be used. The sides 340, 350 of the slat retainer 330 may have a height similar to the first end 170 of the fence slat 100 from about the terminating point 190 down to the first end 170. Likewise, the fence slat 330 may have a width of approximately the same dimension as the tube 110 for a locking fit.

In use, any number of the fence slats 100 may be placed through the links 310 of the chain link fence 320. Likewise, the slat retainer 330 may be positioned through the links 310 on the bottom end of the chain link fence 320. The slat retainer 330 also can be used on the top end of the chain link fence 320 or on both ends. The locking portion (or portions 175) of each fence slat 100 is inserted into the locking portion 370 of the slat retainer 330. Specifically, the second cutout portion 220 of the fence slat 100 squeezes through the cutout portion 390 of the slat retainer 330 until the elevated portion 210 of the fence slat 100 mates with the elevated portion 380 of the slat retainer 330. The fence slat 100 is now locked into the slat retainer 330.

Removal of the fence slat 100 is accomplished by pulling the flared-out portion 400 on the first or second side 340, 350 of the slat retainer 330 until the elevated portion 310 of the fence slat 100 clears the elevated portion 380 of the slat retainer 330. The fence slat 100 then may be removed through the links 310 of the chain link fence 320.

Figure 5:
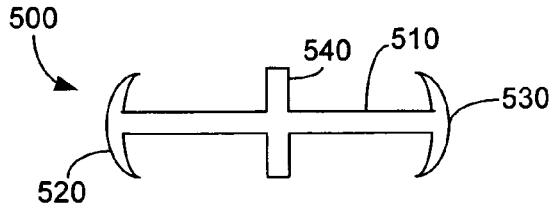
FIG. 5 is a side cross-sectional view of an alternative embodiment of a fence slat of the present invention.

FIG. 5 shows an alternative embodiment of the present invention, a fence slat 500. Instead of the tube 110, the fence slat 500 may have a single strip 510 that runs the length of the slat 500. Attached on either end of the strip 510 may be the sidewalls 520, 530 substantially in the shape of the first and second sidewalls 120, 130 of the fence slat 100 described above. The fence slat 500 may or may not use a rib 540. If the rib 540 is used, the rib 540 may be positioned only about one end, both ends, or the length of the strip 510. The slat 500 may include the locking portion 175 substantially as described above about the first end 170 of the fence slat 100.

Figure 6:
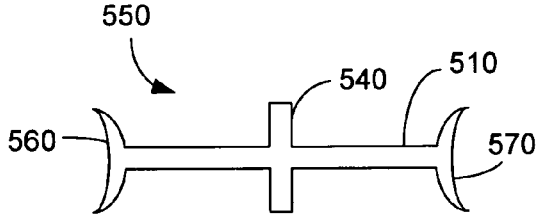
FIG. 6 is a side cross-sectional view of a further embodiment of a fence slat of the present invention.

FIG. 6 shows a further alternative embodiment, a fence slat 550. The fence slat 550 is similar to the fence slat 500, but instead of the inward facing first and second sidewalls 520, 530, the fence slat 550 has a first sidewall 560 and a second sidewall 570 that are curved outwardly away from the strip 510. As above, the fence slat 550 may or may not use the rib 540. If the rib 540 is used, the rib 540 may be positioned only about one end, both ends, or the length of the strip 510. The fence slat 550 may include the locking portion 175 substantially as described above about the first end 170 of the fence slat 100.

Figure 7:
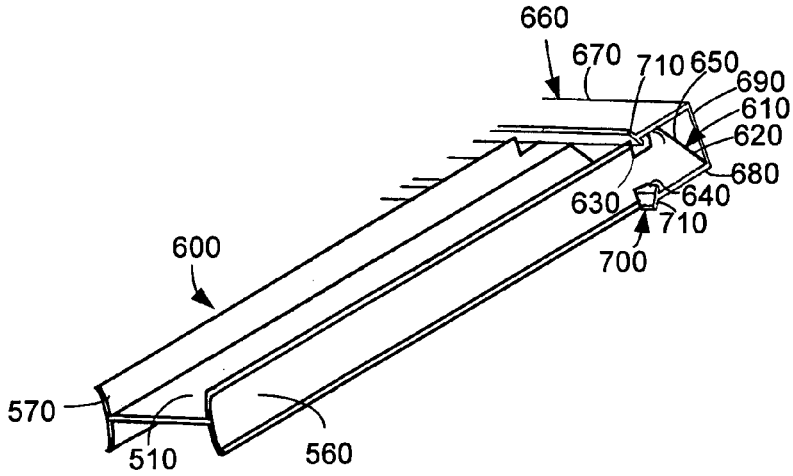
FIG. 7 is a perspective view of a further embodiment of a fence slat and a slat retainer of the present invention.

FIG. 7 shows a further alternative embodiment, a fence slat 600. In this embodiment, the fence slat 600 may be substantially identical to the fence slat 550, but with a locking portion 610 of different configuration as compared to the locking portion 175 described above.

In this example, the locking portion 610 may be largely "arrow" shaped. The locking portion 610 may extend along a first end 620 of the first and the second sidewalls 560, 570 of the strip 510. The first and second sidewalls 560, 570 may extend to an upper and lower cutout portion 630, 640. Although the cutout portions 630, 640 are shown as being substantially rectangular in shape, any desired shape or size may be used. The first and the second sidewalls 560, 570 then may continue with a further ending cutout portion 650. Although the cutout portion 650 is shown as a sharp or straight angle, any desired shape or angle may be used.

As above, the fence slat 600 may or may not use the rib 540. If the rib 540 is used, the rib 540 may be positioned only about one end, both ends, or the length of the strip 510. The locking portion 610 as described herein also may be used with the configurations shown above in the fence slat 100, the fence slat 500, the fence slat 550, and otherwise. Likewise, although the locking portion 610 is shown as largely "arrow" shaped, any desired size or shape may be used.

Because of the use of the upper and lower cutout portions 630, 640, the fence slat 600 may mate with a slat retainer 660 of somewhat different configuration. In this example, the slat retainer 660 may have a first side 670 and a substantially parallel second side 680. A base 690 may separate the sides 670, 680. One or both sides 670, 680 of the slat retainer 660 may have a locking portion 700 designed to mate with the locking portion 610 of the fence slat 600. Specifically, the locking portion 700 of the slat retainer 660 may have an indented portion 710 on one or both sides 670, 680. The indented portion 710 may be angled and may extend within the slat retainer 600. The indented portions 710 may mate with the upper and lower cutout portion 630, 640 of the sidewalls 520, 530 of the fence slat 600.

Figure 8:
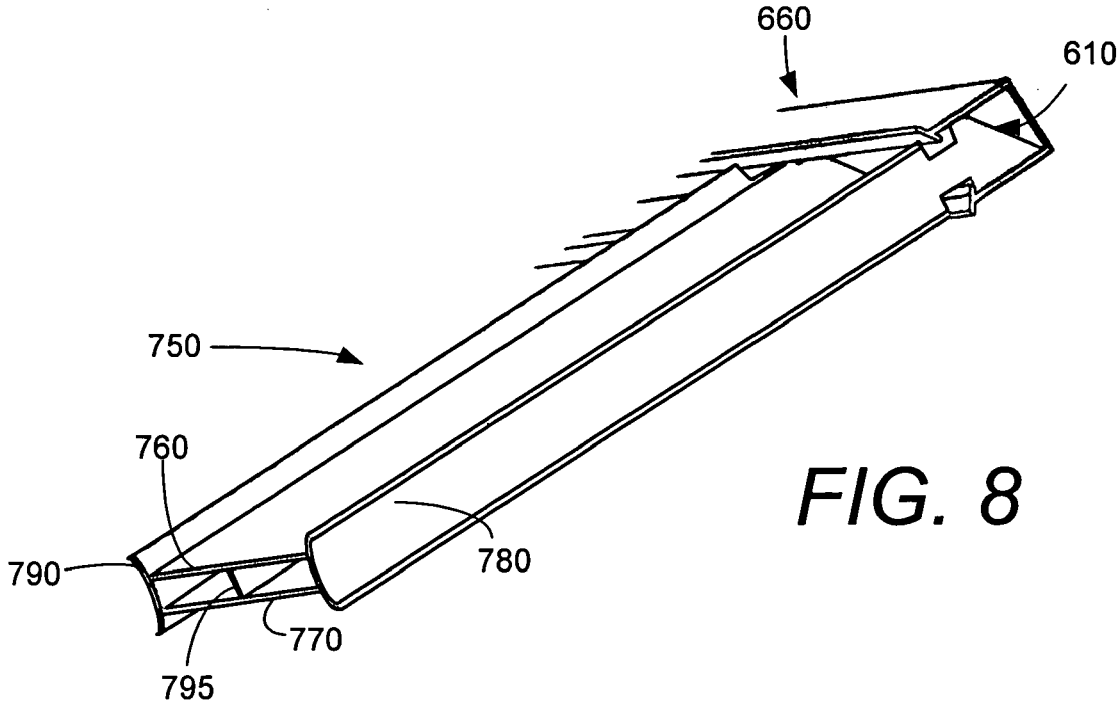
FIG. 8 is a perspective view of a further embodiment of a fence slat and a slat retainer of the present invention.

FIG. 8 shows a further alternative embodiment, a fence slat 750. In this embodiment, fence slat 750 may include a flat first and a flat second side 760, 770 similar to the flat first and second sides 120, 130. The first and second sides 760, 770 may be connected by a first and a second sidewall 780, 790 similar to the first and second sidewalls 560, 570 in that the sidewalls 780, 790 extend outwardly. Although the sidewalls 780, 790 are showing as extending beyond the sides 760, 770, the sidewalls 780, 790 also may mate with the sides 760, 770. Any desired orientation of the sidewalls 780, 790 also may be used. The fence slat 750 also may use a rib 795 similar to the rib 540. If the rib 795 is used, the rib 795 may be positioned only about one end, both ends, or the sides 760, 770.

As is shown, the fence slat 750 also may use the locking portion 610 in connection with the slat retainer 660. The fence slat 750 also may use the locking portion 175 as described above with the slat retainer 330 or any similar shape.

Figure 9:
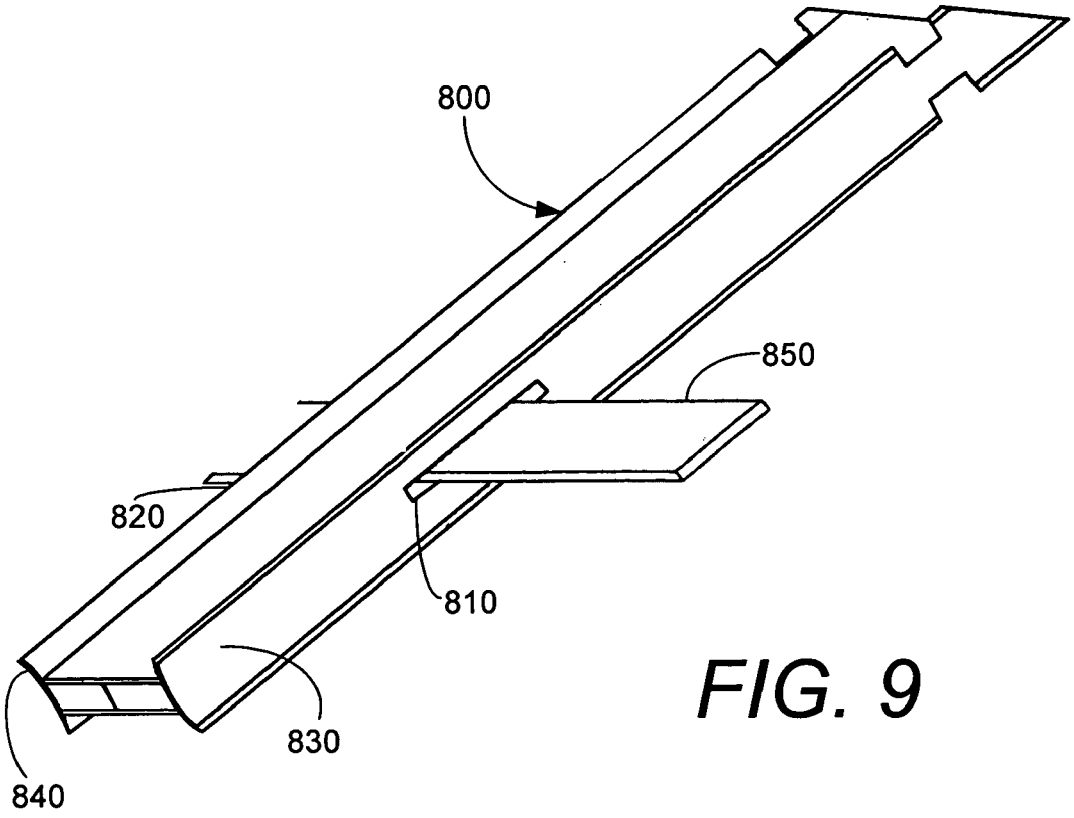
FIG. 9 is a perspective view of a further embodiment of a fence slat of the present invention.

FIG. 9 shows a further embodiment, a fence slat 800. The fence slat 800 may take the form of any of the different slats described above. The fence slat 800 may include upper apertures 810, 820 extending through a first and a second sidewall 830, 840. The apertures 810, 820 are designed to accommodate an upper rail 850 for further stability. The upper rail 850 may extend through any number of fence slats 800. The upper rail 850 may be made out of a plastic or any convenient material.

It should be understood that the foregoing description relates only to the exemplary embodiments of the present invention and that numerous changes and modifications may be made herein without departing from the general spirit and scope of the invention as defined by the following claims and the equivalents thereof.

What is claimed is:

1. A fence slat, comprising:

a longitudinal hollow body;

the longitudinal body comprising a first side and a second side;

a first sidewall positioned on the first side of the longitudinal body;

a second sidewall positioned on the second side of the longitudinal body; and a rib positioned between the first side wall and the second side wall so as to divide said longitudinal hollow body into two separate enclosed chambers;

the first and the second sidewalls and the rib each comprising a harpoon-shaped locking portion positioned thereon.

2. The fence slat of claim 1, wherein the first side wall comprises a first curved sidewall and wherein the second sidewall comprises a second curved sidewall.

3. The fence slat of claim 2, wherein the first and the second curved sidewalls comprise a curve towards the longitudinal body.

4. The fence slat of claim 1, wherein the longitudinal body comprises a tube.

5. The fence slat of claim 4, wherein the tube comprises a substantially flat first side and a substantially flat second side.

6. The fence slat of claim 5, wherein the tube comprises the rib separating the substantially flat first side and the substantially flat second side.

7. The fence slat of claim 5, wherein the substantially flat first side comprises a terminating point adjacent to the first end.

8. The fence slat of claim 4, wherein tube comprises a first end and a second end and wherein the first end comprises the locking portion.

9. The fence slat of claim 1, wherein the locking portion comprises a cutout portion and an elevated portion.

10. The fence slat of claim 1, further comprising a second locking portion.

11. A fence slat, comprising:

a hollow longitudinal body;

the hollow longitudinal body comprising a first wall and a second wall;

a pair of sidewalls connecting the first wall and the second wall;

a rib connecting the first wall and the second wall of the hollow longitudinal body so as to divide the hollow longitudinal body into two separate enclosed chambers; and the pair of sidewalls and the rib each comprising a harpoon-shaped locking portion positioned thereon.

12. A fence slat for use with a rail, comprising:

a hollow longitudinal body;

the hollow longitudinal body comprising a first wall and a second wall;

a pair of sidewalls connecting the first wall and the second wall;

a rib connecting the first wall and the second wall of the hollow longitudinal body so as to divide the hollow longitudinal body into two separate enclosed chambers; and the pair of sidewalls and the rib each comprising harpoon shaped locking means for locking the longitudinal body within the rail.

* * * * *